US009354580B2

(12) United States Patent
Takahashi et al.

(10) Patent No.: US 9,354,580 B2
(45) Date of Patent: May 31, 2016

(54) IMAGE FORMING APPARATUS

(71) Applicant: CANON KABUSHIKI KAISHA, Tokyo (JP)

(72) Inventors: Genki Takahashi, Mishima (JP); Masayoshi Fukatsu, Suntou-gun (JP); Hiroharu Tsuji, Numazu (JP); Yohei Suzuki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/685,323

(22) Filed: Apr. 13, 2015

(65) Prior Publication Data

US 2015/0301490 A1 Oct. 22, 2015

(30) Foreign Application Priority Data

Apr. 16, 2014 (JP) ..... 2014-084713

(51) Int. Cl.
*G03G 15/00* (2006.01)

(52) U.S. Cl.
CPC ..... *G03G 15/6552* (2013.01); *G03G 15/5016* (2013.01); *G03G 15/5091* (2013.01); *G03G 15/6529* (2013.01); *G03G 2215/00088* (2013.01); *G03G 2215/00299* (2013.01); *G03G 2215/00421* (2013.01); *G03G 2215/00438* (2013.01); *G03G 2215/00586* (2013.01); *G03G 2215/00603* (2013.01)

(58) Field of Classification Search
CPC G03G 15/50; G03G 15/5016; G03G 15/5091
See application file for complete search history.

(56) References Cited

U.S. PATENT DOCUMENTS

| | | | | |
|---|---|---|---|---|
| 5,697,761 | A * | 12/1997 | Morgan et al. | 414/790.3 |
| 2008/0209531 | A1* | 8/2008 | Hayano | 726/6 |
| 2009/0021779 | A1* | 1/2009 | Hagiwara | 358/1.15 |

FOREIGN PATENT DOCUMENTS

| | | | |
|---|---|---|---|
| JP | H08-2790 | A | 1/1996 |
| JP | 2000-190600 | A | 7/2000 |
| JP | 2004-42323 | A | 2/2004 |
| JP | 2013-220905 | A | 10/2013 |

* cited by examiner

*Primary Examiner* — David Gray
*Assistant Examiner* — Thomas Giampaolo, II
(74) *Attorney, Agent, or Firm* — Canon U.S.A., Inc., IP Division

(57) ABSTRACT

An image forming apparatus includes an apparatus main body including an opening, an image forming unit, a storage portion, a moving unit, and a control unit. The control unit switches between a first state and a second state, the first state being a state where the moving unit is prohibited from moving and exposing a first sheet when information about a second user different from a first user who has instructed to print a first sheet is received, and the second state being a state where the moving unit is permitted to move and expose the first sheet if information about the second user is received.

10 Claims, 13 Drawing Sheets

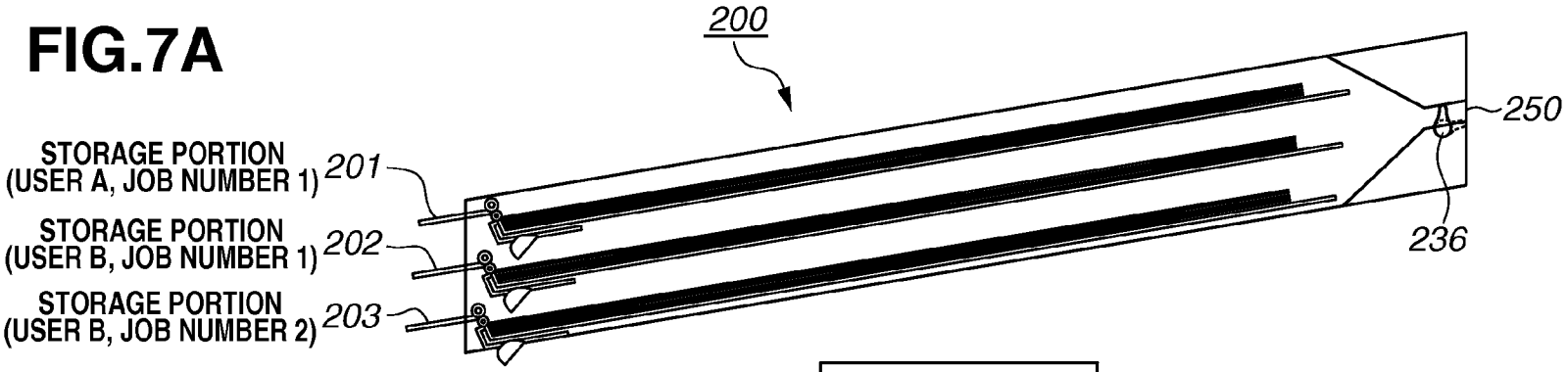
FIG.7A
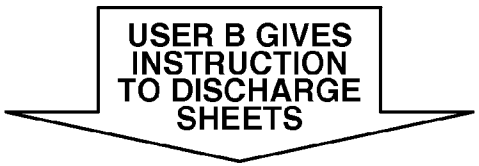
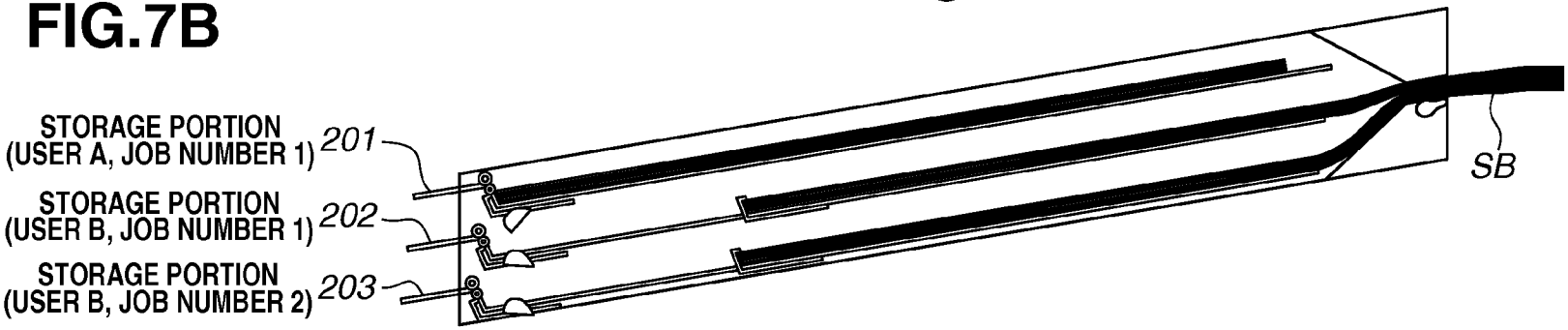
FIG.7B

FIG.9A

| STORAGE PORTION | JOB NUMBER | USER | SHEET-DISCHARGE PERMISSION INFORMATION 355 | |
|---|---|---|---|---|
| | | | CHANGE PERMISSION | SHEET-DISCHARGE PERMISSION RANGE |
| 201 | 1 | A | NOT PERMITTED | ONLY THE SAME USER |
| 202 | 2 | B | PERMITTED | ONLY THE SAME USER |
| 203 | 3 | C | PERMITTED | UNLIMITED |

FIG.9B

| USER | USER INFORMATION 356 | |
|---|---|---|
| | USER ID | PRINTER MANAGEMENT AUTHORITY |
| A | xxx | AUTHORIZED |
| B | yyy | NOT AUTHORIZED |
| C | zzz | NOT AUTHORIZED |

FIG.12A

| STORAGE PORTION | JOB NUMBER | USER | SHEET-DISCHARGE PERMISSION INFORMATION 355 | | STORAGE TIME PERIOD |
|---|---|---|---|---|---|
| | | | CHANGE PERMISSION | SHEET-DISCHARGE PERMISSION RANGE | |
| 201 | 1 | E | PERMITTED | ONLY THE SAME USER | 3 min |
| 202 | 2 | F | PERMITTED | ONLY THE SAME USER | 15 min |
| 203 | 3 | G | PERMITTED | ONLY THE SAME USER | 70 min |

FIG.12B

| STORAGE PORTION | JOB NUMBER | USER | SHEET-DISCHARGE PERMISSION INFORMATION 355 | | STORAGE TIME PERIOD |
|---|---|---|---|---|---|
| | | | CHANGE PERMISSION | SHEET-DISCHARGE PERMISSION RANGE | |
| 201 | 1 | H | PERMITTED | ONLY THE SAME USER | 3 min |
| 202 | 2 | I | PERMITTED | ONLY THE SAME USER | 70 min |
| 203 | | | | | |

IMAGE FORMING APPARATUS

BACKGROUND

1. Field

Aspects of the present invention generally relate to an image forming apparatus including a storage portion that temporarily stores a sheet on which an image is formed.

2. Description of the Related Art

Conventionally, there has been an image forming apparatus, such as a copying machine and a printer, including a storage portion that temporarily stores sheets inside the image forming apparatus so that the user can take out only his/her own sheets on which an image is formed.

Japanese Patent Application Laid-Open No. 2013-220905 discuses an image forming apparatus including a plurality of storage portions which temporarily store image-formed sheets inside the image forming apparatus, aside from an ordinary sheet-discharge tray which is arranged on the top surface of the main body of the image forming apparatus and is shared by a plurality of users. To take out the sheets stored in a storage portion, the user performs user authentication using an identification (ID) card. The user authentication is performed by the user causing own ID card to be read by an ID card reading unit arranged on the image forming apparatus. If the user authentication is successfully performed, the sheets belonging to the user who has instructed to discharge the sheets are discharged to the outside of the image forming apparatus. As a result, the user can take out only his/her own sheets on which an image is formed.

In a configuration where the storage portions are arranged inside the image forming apparatus as discussed in Japanese Patent Application Laid-Open No. 2013-220905, the number of sheets that can be stored in the storage portions is limited. Since user authentication using an ID card is needed to take out the sheets stored in the storage portions, persons other than the user who has instructed to print the sheets cannot take out the sheets. Therefore, if sheets are stored in all the storage portions and then if the user forgets to take out the sheets from a storage portion, the state where the storage portion cannot be used by other users continues.

SUMMARY

Aspects of the present invention are generally directed to a technique that reduces time until a storage portion becomes available to other users if the storage portion contains a sheet or sheets.

According to an aspect of the present invention, an image forming apparatus includes an apparatus main body including an opening, an image forming unit configured to form an image on a sheet, a storage portion configured to store the sheet on which the image is formed inside the apparatus main body, a moving unit configured to move the sheet stored in the storage portion and expose the sheet outside of the apparatus main body via the opening, and a control unit configured to, if the control unit receives user information, control whether the moving unit can move and expose the sheet, wherein the control unit is configured to, if a first sheet is stored in the storage portion and if the control unit receives information about a first user who has instructed to print the first sheet, permit the moving unit to move and expose the first sheet, and wherein the control unit is configured to be able to switch between a first state and a second state, the first state being a state where the moving unit is prohibited from moving and exposing the first sheet if the control unit receives information about a second user different from the first user, and the second state being a state where the moving unit is permitted to move and expose the first sheet if the control unit receives the information about the second user.

Further features of the present disclosure will become apparent from the following description of exemplary embodiments with reference to the attached drawings.

BRIEF DESCRIPTION OF THE DRAWINGS

FIGS. 7A and 7B are diagrams illustrating a state of the storage device when exposing sheets according to the first exemplary embodiment.

FIGS. 9A and 9B illustrate setting examples of sheet-discharge permission information and user information according to the first exemplary embodiment.

FIGS. 12A and 12B illustrate setting examples of the sheet-discharge permission information according to the second exemplary embodiment.

DESCRIPTION OF THE EMBODIMENTS

In a first exemplary embodiment, a sheet-discharge permission range is changed according to a time period during which a sheet has been stored in a storage portion. A detailed description will be given below with reference to the drawings.

(Configuration Diagram of Image Forming Apparatus)

Figure 1:
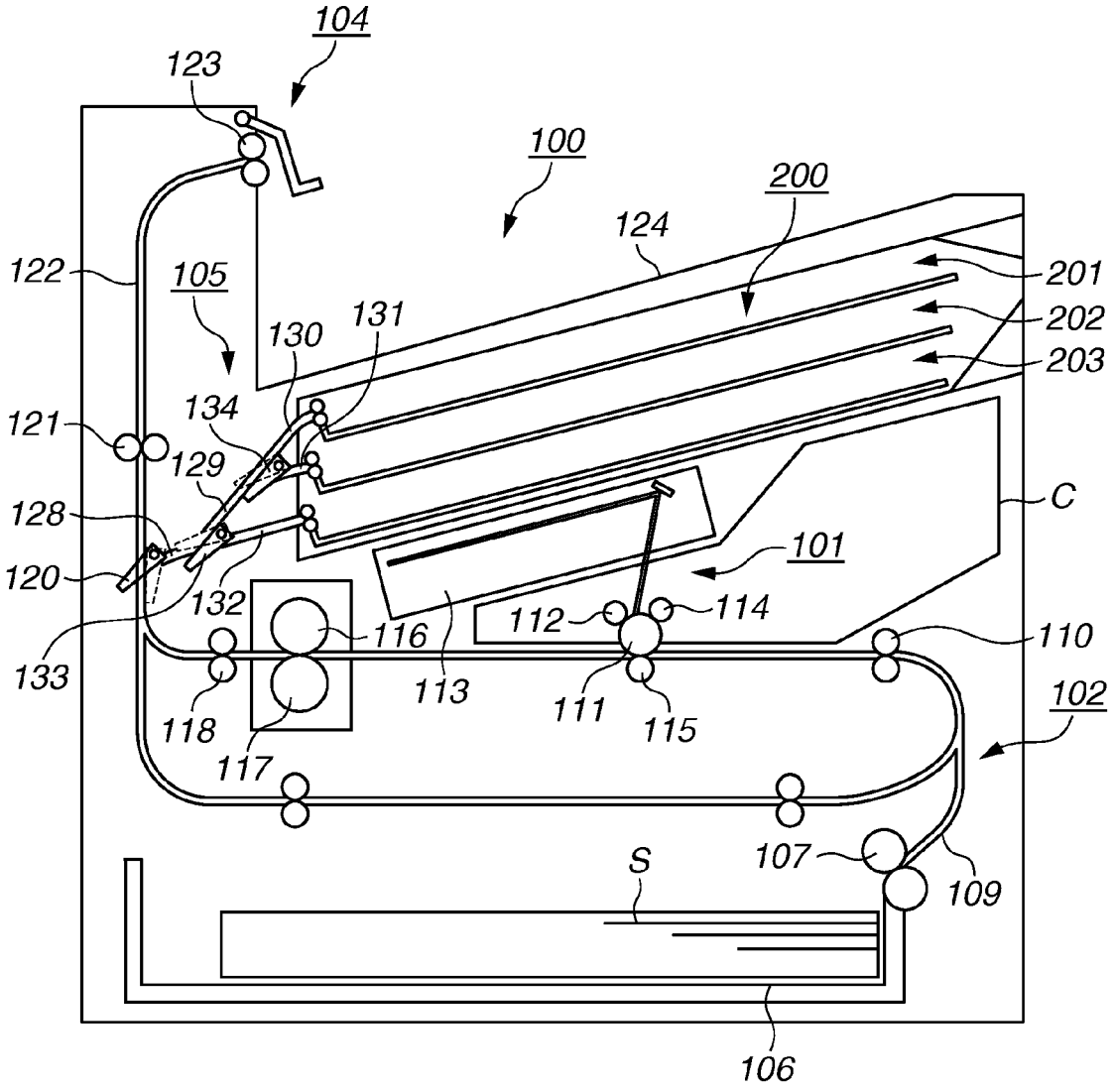
FIG. 1 is a diagram illustrating a configuration of an image forming apparatus according to a first exemplary embodiment.

FIG. 1 is a diagram illustrating a configuration of an image forming apparatus including storage portions according to the first exemplary embodiment. In the present exemplary embodiment, a laser beam printer will be described as an example of the image forming apparatus.

The image forming apparatus 100 includes an image forming unit 101, a supply unit 102 which supplies sheets S to the image forming unit 101, and a sheet-discharge unit 104 which discharges the sheets S on which an image is formed by the image forming unit 101. Here, the sheets S refer to sheets on which an image is formed by the image forming apparatus 100, and include paper, an overhead projector (OHP) sheet, and a cloth, for example. The image forming apparatus 100 includes a storage device 200 above the image forming unit 101. The storage device 200 includes a plurality of storage portions 201 to 203 which temporarily stores the image-formed sheets S inside the image forming apparatus 100. The image forming apparatus 100 further includes a conveyance unit 105 which conveys the image-formed sheets S to the storage device 200.

The image forming unit 101 includes a photosensitive drum 111, a charging roller 112, and an exposure unit 113. The photosensitive drum 111 rotates in the clockwise direction (CW direction) in FIG. 1. The charging roller 112 charges the surface of the photosensitive drum 111. The exposure unit 113 irradiates the photosensitive drum 111 with light to form an electrostatic latent image. The image forming unit 101 further includes a developing unit 114 and a transfer roller 115. The developing unit 114 makes toner adhere to the electrostatic latent image to form a toner image on the photosensitive drum 111. The transfer roller 115 transfers the toner image to the conveyed sheet S. The image forming unit 101 further includes a fixing roller 116, a pressure roller 117 in contact with the fixing roller 116, and a fixing discharge roller 118, and fixes the toner image transferred to the sheet S on the sheet S. The image forming unit 101 forms a toner image on a sheet S using such an electrophotographic image forming process. In the image forming apparatus 100 according to the present exemplary embodiment, the photosensitive drum 111, the charging roller 112, the developing unit 114, and a toner container (not illustrated) for storing toner are integrated as a cartridge C. The cartridge C is configured to be detachably attached to the main body of the image forming apparatus 100. If the image forming apparatus 100 runs out of toner, the user can replace the cartridge C with a new one. The user can thus perform maintenance of the image forming apparatus 100 by himself/herself without relying on a serviceperson. The present disclosure is not limited to the image forming apparatus 100 of such a cartridge type. An exemplary embodiment may be applied to a configuration in which members such as the photosensitive drum 111, the charging roller 112, and the developing unit 114 are fixed to the image forming apparatus 100 (a type in which the members do not need to be replaced).

The supply unit 102 includes a supply cassette 106, a supply roller 107, a conveyance guide 109, and a registration roller 110. A plurality of sheets S to be used for image formation is stacked and stored in the supply cassette 106.

The sheet-discharge unit 104 includes a first switching member 120, a conveyance roller 121, a sheet-discharge guide 122, a sheet-discharge roller 123, and a sheet-discharge tray 124. The first switching member 120 is configured to be switchable between a position illustrated in solid lines in FIG. 1 and a position illustrated in broken lines by an actuator (not illustrated). The position illustrated in the solid lines is intended to direct the image-formed sheet S to the storage device 200. The position illustrated in the broken lines is intended to direct the image-formed sheet S to the sheet-discharge tray 124. The sheet-discharge tray 124 is arranged on the top surface of the image forming apparatus 100, and can be shared by a plurality of users. The sheet S is discharged to the sheet-discharge tray 124 with the image-formed side (surface) facing down (face down state).

The conveyance unit 105 includes second and third switching members 133 and 134 for switching a conveyance destination of the sheet S, and conveyance guides 128 to 132 for guiding the sheet S to the storage portions 201 to 203. The second and third switching members 133 and 134 are configured to be switchable between a position illustrated in solid lines in FIG. 1 and a position illustrated in broken lines by actuators (not illustrated). For example, when the sheet S is conveyed to the first storage portion 201, the second and third switching members 133 and 134 are both located in the respective positions illustrated in the solid lines in FIG. 1. The sheet S is passed through the conveyance guides 128, 129, and 130 in this order and conveyed to the storage portion 201. When the sheet S is conveyed to the second storage portion 202, only the third switching member 134 is switched to the position illustrated in the broken lines. In such a case, the sheet S is passed through the conveyance guides 128, 129, and 131 in this order and conveyed to the storage portion 202. As is the case with the sheet-discharge tray 124, the sheet S is stored in the face down state in the storage portions 201 to 203.

(Configuration Diagram of Storage Device)

Figure 2:
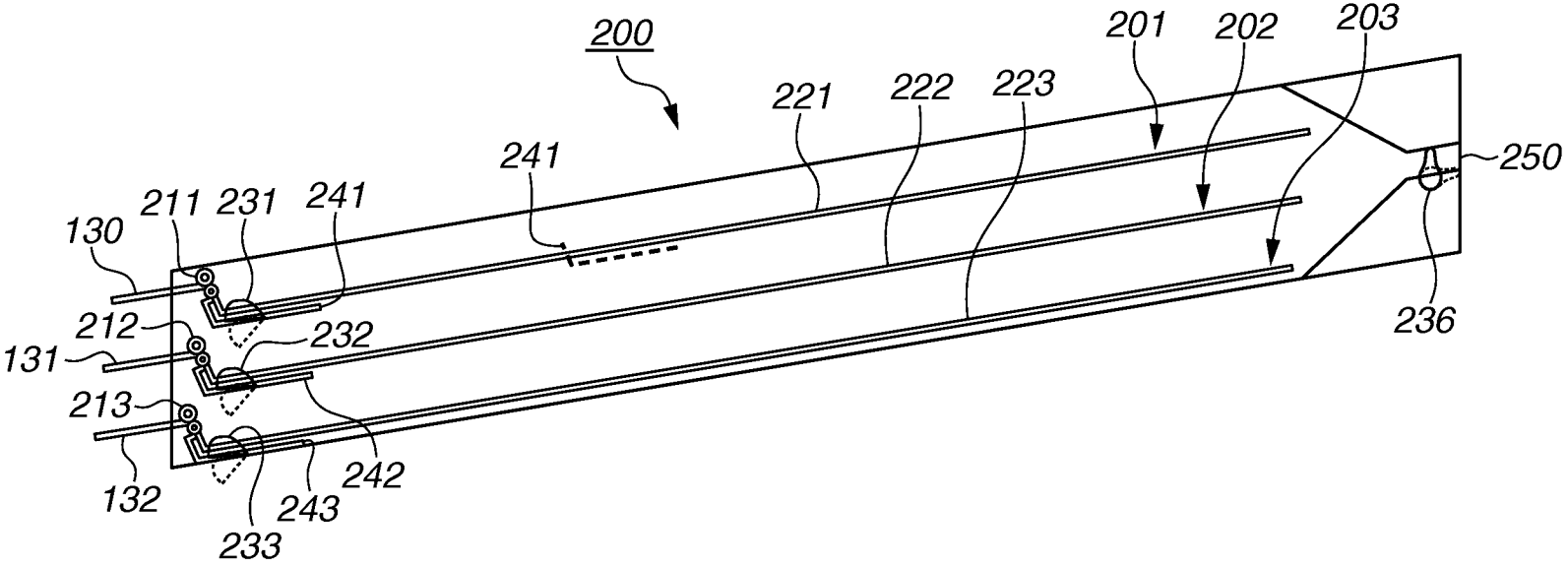
FIG. 2 is a diagram illustrating a configuration of a storage device according to the first exemplary embodiment.

FIG. 2 is a diagram illustrating a configuration of the storage device 200. In the storage device 200 according to the present exemplary embodiment, the plurality of storage portions 201 to 203 is configured to be stacked in the vertical direction. The storage portions 201 to 203 have similar configurations. A configuration of the first storage portion 201 will be described below.

The storage portion 201 includes a conveyance roller 211, a stacking tray 221, and a sheet presence/absence sensor 231. The conveyance roller 211 conveys a sheet S. The stacking tray 221 temporarily stacks and stores the sheet S. The sheet presence/absence sensor 231 detects whether the sheet S is stored on the stacking tray 221. The storage portion 201 further includes a sheet moving unit 241 which presses the trailing edge of the sheet S stored inside (the edge of the sheet S on the upstream side in the conveyance direction) to expose a part of the stored sheet S to the outside of the image forming apparatus 100. The sheet moving unit 241 moves the sheet S to a position where the user can receive the sheet S, i.e., until the leading edge of the sheet S (the edge of the sheet S on the downstream side in the conveyance direction) passes through an opening 250. As a result, the sheet S can be exposed to the outside of the image forming apparatus 100 by a predetermined length. In the present exemplary embodiment, the predetermined length by which the sheet S is exposed to the outside of the image forming apparatus 100 is set to 30 mm. This predetermined length is just an example and may be set to a length long enough for the user to hold the exposed sheet S and to prevent the sheet S from sagging largely.

The stacking tray 221 has a length long enough that even if a sheet S having a maximum size storable in the storage portion 201 is stacked, the leading edge of the sheet S is not exposed from the opening 250. If a sheet S is stacked on the stacking tray 221 and the stacked sheet S presses down the sheet presence/absence sensor 231 to the position of the broken line, the sheet presence/absence sensor 231 is turned on. If the sheet S is moved by the sheet moving unit 241 and the sheet presence/absence sensor 231 returns to the position of the solid line, the sheet presence/absence sensor 231 is turned off. If the leading edge of the moved sheet S presses an opening sensor 236 arranged near the opening 250 to the position of the broken line, the opening sensor 236 is turned on. If the sheet S exposed to the outside of the image forming apparatus 100 is removed and the opening sensor 236 returns to the position of the solid line, the opening sensor 236 is turned off. When sheets S are being successively conveyed to the storage portion 201, the sheet moving unit 241 is located in a stacking position illustrated by the solid line. The sheet moving unit 241 is configured to, when the stored sheets S are exposed, be able to move toward the opening 250 in the conveyance direction of the sheets S to an exposure position illustrated by the broken line. The position of the sheet moving unit 241 when exposing sheets S, i.e., a moving distance of the sheet moving unit 241 is determined according to the length by which the sheets S are exposed and the size of the sheets S in the conveyance direction.

Figure 3:
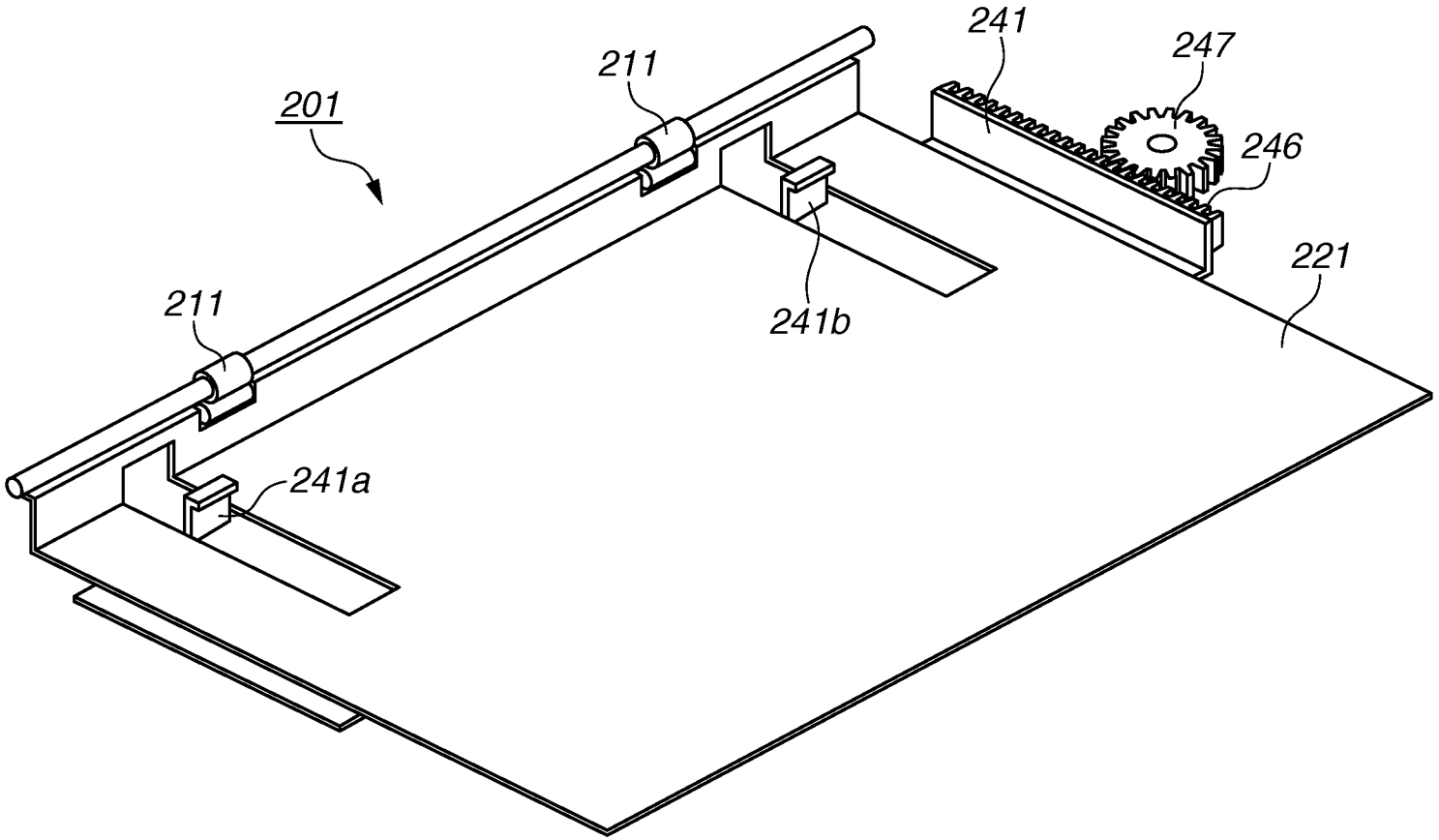
FIG. 3 is a perspective view of a storage portion according to the first exemplary embodiment.

FIG. 3 is a perspective view of the storage portion 201. In FIG. 3, the sheet moving unit 241 is located between the stacking position and the exposure position. The sheet moving unit 241 includes two sheet trailing edge pressing portions 241*a* and 241*b* in the width direction of a sheet S. The sheet moving unit 241 integrally includes a rack 246. The rack 246 meshes with a pinion 247. The pinion 247 is connected to an actuator serving as a driving unit which is not illustrated in FIG. 3. The actuator can be driven in the forward direction or backward direction to reciprocate the sheet moving unit 241 between the stacking position and the exposure position.

(Block Diagram of Control Unit and Functional Configuration)

Figure 4:
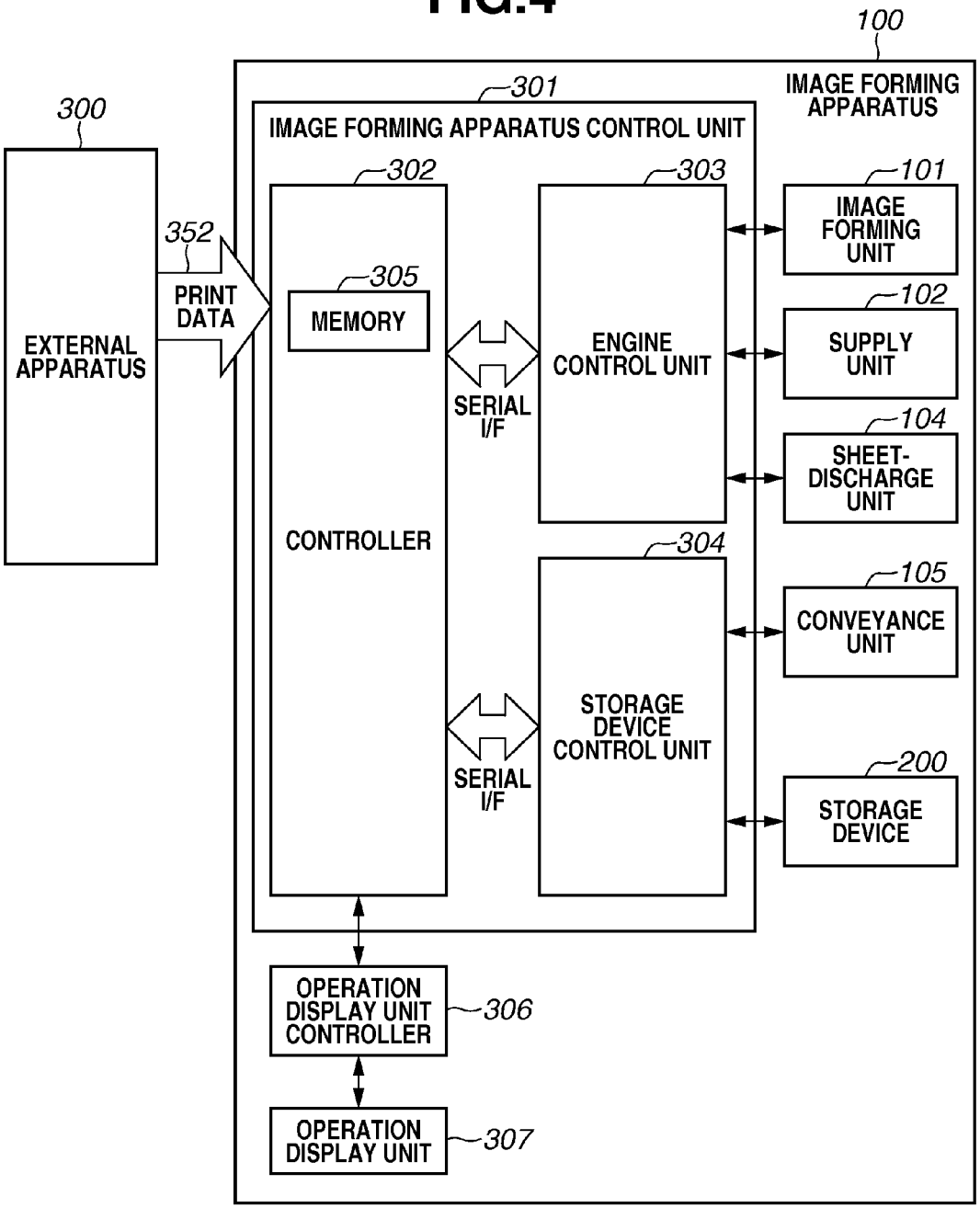
FIG. 4 is a block diagram illustrating a control unit and a functional configuration of the image forming apparatus according to the first exemplary embodiment.

FIG. 4 is a block diagram illustrating a control unit and a functional configuration according to the present exemplary embodiment. The image forming apparatus 100 includes an image forming apparatus control unit 301 as a control unit. The image forming apparatus control unit 301 includes a controller 302, an engine control unit 303, and a storage device control unit 304.

The controller 302 communicates with an external apparatus 300 such as a host computer to receive print data 352, and stores the received print data 352 into a memory 305 (e.g., random access memory (RAM)). The controller 302 analyzes the print data 352 stored in the memory 305 to generate a print condition. The print condition refers to information indicating the number of sheets S to be supplied, the destination to which the image-formed sheets S are discharged (the sheet-discharge tray 124 or the storage device 200), and image density for printing. The controller 302 notifies the engine control unit 303 via a serial interface (I/F) of the print condition generated from the print data 352. The engine control unit 303 controls each mechanism according to the print condition received from the controller 302. More specifically, the engine control unit 303 controls the image forming unit 101 to form an image on a sheet S. The engine control unit 303 controls the supply unit 102 and the sheet-discharge unit 104 to supply and discharge the sheet S.

The controller 302 analyzes the print data 352 stored in the memory 305 to generate a storage condition and a discharge condition of the storage portions 201 to 203. The controller 302 notifies the storage device control unit 304 via a serial I/F of the storage condition and the discharge condition generated from the print data 352. The storage condition refers to information about a destination in which image-formed sheets S are stored and the number of sheets S to be stored. The discharge condition refers to information about distances by which any of the sheet moving units 241 to 243 is moved to expose sheets S from the opening 250. The storage device control unit 304 controls each mechanism according to the storage condition and the discharge condition received from the controller 302. More specifically, the storage device control unit 304 controls the conveyance unit 105 to convey the image-formed sheets S to any of the storage portions 201 to 203. The storage device control unit 304 further controls the storage device 200 including the sheet moving unit 241 to move the sheets S stored in any of the storage portions 201 to 203 to the opening 250. An operation display unit controller 306 performs control to notify the controller 302 of various settings and discharge instructions made by the user from an operation display unit 307.

(Details of Storage Device Control Unit)

Figure 5:
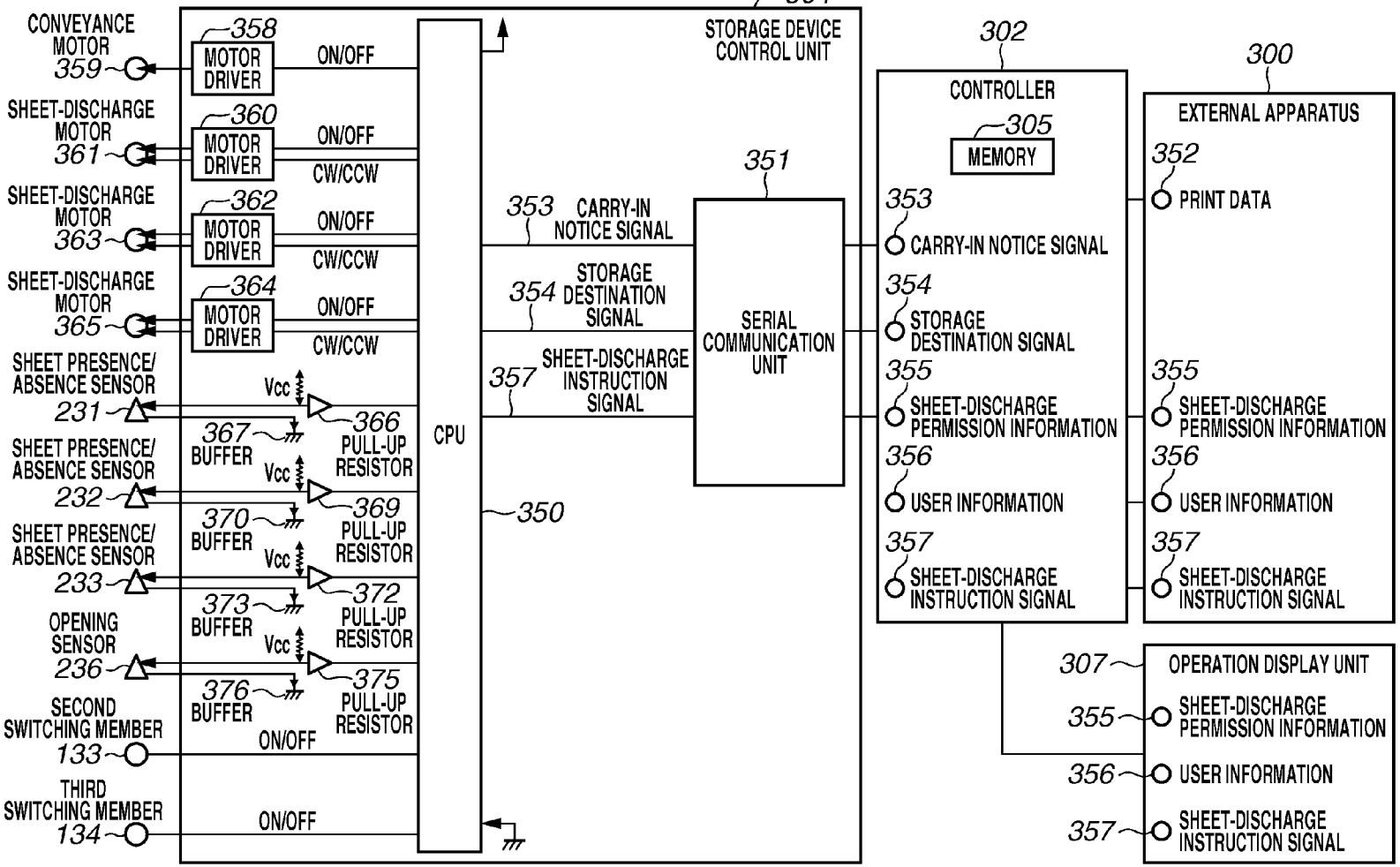
FIG. 5 is a detailed diagram illustrating a storage device control unit according to the first exemplary embodiment.

FIG. 5 is a detailed diagram of the storage device control unit 304 according to the present exemplary embodiment. The storage device control unit 304 includes a central processing unit (CPU) 350. The storage device control unit 304 communicates with the controller 302 via a serial communication unit 351. The serial communication unit 351 connects the CPU 350 and the controller 302 by a plurality of signal lines.

Control when sheets S are stored into the storage device 200 will be described below. If print data 352 is transmitted to the controller 302 via the external apparatus 300, the controller 302 temporarily stores the print data 352 into the memory 305. The controller 302 then analyzes the stored print data 352, and notifies the CPU 350 of a carry-in notice signal 353 and a storage destination signal 354 via the serial communication unit 351. Based on the notified signals, the CPU 350 controls each actuator to be described below to convey printed sheets S to any of the storage portions 201 to 203. In the present exemplary embodiment, the user can give an instruction to print sheets S and set the sheet-discharge permission range of the sheets S. If the user sets the sheet-discharge permission range of the sheets S from the external apparatus 300 or the operation display unit 307, the controller 302 associates job numbers of the sheets S stored in the storage portions 201 to 203 with sheet-discharge permission information 355, and stores the resultant into the memory 305. The sheet-discharge permission information 335 will be described in detail below.

Next, control when sheets S are taken out from the storage device 200 will be described. If the user gives an instruction to discharge sheets S stored in a storage portion using the external apparatus 300 or the operation display unit 307, the controller 302 is notified of a sheet-discharge instruction signal 357. In the present exemplary embodiment, user authentication is needed to take out the sheets S. The user inputs user information 356 (e.g., ID number) from which each individual user can be identified from the external apparatus 300 or the operation display unit 307. The controller 302 determines whether to permit to discharge the sheets S based on the user information 356 notified and the sheet-discharge permission information 355 stored in the memory 305. If the controller 302 determines to permit to discharge the sheets S, the controller 302 notifies the CPU 350 of the sheet-discharge instruction signal 357 via the serial communication unit 351, instructing the corresponding storage portion to discharge the stored sheets S. The CPU 350 controls each actuator to be described below to expose the sheets S in the storage portion of which the CPU 350 is notified from the opening 250 to the outside of the image forming apparatus 100. The user information 356 and the processing of the user authentication will be described in detail below.

Next, the actuators connected to the CPU 350 will be described.

A motor driver 358 is connected to an output terminal of the CPU 350. The motor driver 358 drives a conveyance motor 359. The conveyance rollers 211, 212, and 213 are rotated by rotation of the conveyance motor 359, whereby a sheet S is conveyed to any of the storage portions 201 to 203.

A motor driver 360 is connected to an output terminal of the CPU 350. The motor driver 360 drives a sheet-discharge motor 361. The sheet-discharge motor 361 is rotated in the clockwise direction (CW direction) to move the sheet moving unit 241 of the storage portion 201 toward the opening 250. The sheet-discharge motor 361 is rotated in the counterclockwise direction (CCW direction) to move the sheet moving unit 241 of the storage portion 201 in the direction opposite to the opening 250. Similarly, motor drivers 362 and 364 are connected to output terminals of the CPU 350. The motor drivers 362 and 364 drive sheet-discharge motors 363 and 365, respectively. The sheet-discharge motor 363 controls a sheet moving unit 242 of the storage portion 202. The sheet-discharge motor 365 controls a sheet moving unit 243 of the storage portion 203.

The sheet presence/absence sensor 231 uses a pull-up resistor 366 to input information about whether a sheet S is stored in the storage portion 201 into the CPU 350 via a buffer 367. A sheet presence/absence sensor 232 similarly inputs information about whether a sheet S is stored in the storage portion 202 into the CPU 350. A sheet presence/absence sensor 233 similarly inputs information about whether a sheet S is stored in the storage portion 203 into the CPU 350.

The opening sensor 236 uses a pull-up resistor 375 to input information about whether a sheet S is exposed from the opening 250 to the outside of the image forming apparatus 100 into the CPU 350 via a buffer 376.

An actuator (not illustrated) for switching the second switching member 133 is connected to an output terminal of the CPU 350. When the actuator is on, the second switching member 133 is switched so that a sheet S is conveyed toward the conveyance guide 129. When the actuator is off, the second switching member 133 is switched so that the sheet S is conveyed toward the conveyance guide 132. Similarly, an actuator (not illustrated) for switching the third switching member 134 is connected to an output terminal of the CPU 350. When the actuator is on, the third switching member 134 is switched so that a sheet S is conveyed toward the conveyance guide 130. When the actuator is off, the third switching member 134 is switched so that the sheet S is conveyed toward the conveyance guide 131. The CPU 350 switches the second and third switching members 133 and 134 based on the storage destination signal 354 notified by the controller 302.

(Description of Operation of Storage Device)

Figure 6:
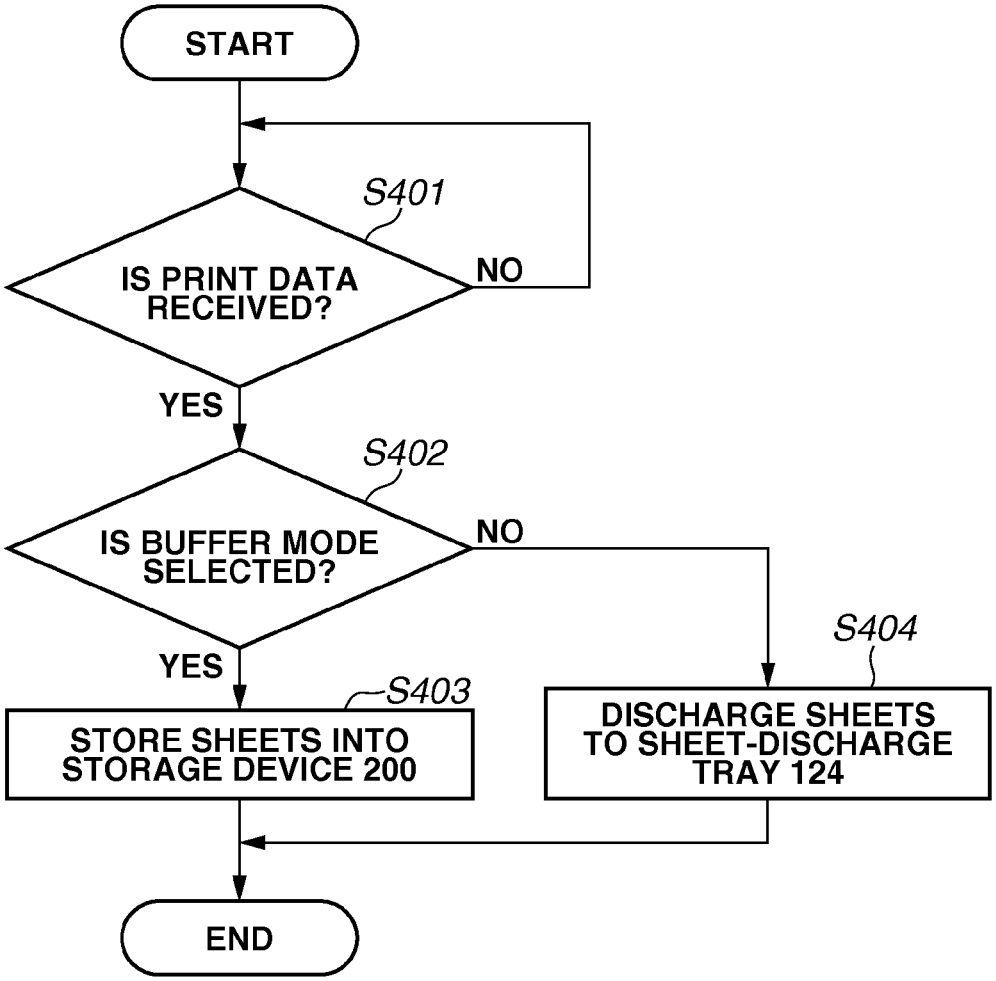
FIG. 6 is a flowchart when printing sheets according to the first exemplary embodiment.

In the image forming apparatus 100 described above, the user can select either one of a buffer mode and a normal mode using the external apparatus 300 or the operation display unit 307. In the buffer mode, sheets S are temporarily stored into the storage device 200. In the normal mode, the sheets S are discharged to the sheet-discharge tray 124. The selected mode is stored into the memory 305. FIG. 6 illustrates a flowchart when the user gives an instruction to print sheets S. The control in the flowchart is performed by the controller 302 described in FIG. 4 based on a program stored in the memory 305.

In step S401, the user gives an instruction to print the sheet S via the external apparatus 300, and the external apparatus 300 transmits the print data 352 to the controller 302. If the print data 352 is received (YES in step S401), then in step S402, the controller 302 refers to information stored in the memory 305 to check whether the buffer mode is selected. If the buffer mode is selected (YES in step S402), then in step S403, the controller 302 temporarily stores the sheets S into the storage device 200. If the normal mode is selected (NO in step S402), then in step S404, the controller 302 discharges the sheets S to the sheet-discharge tray 124. Then, the control of the flowchart ends. The flowchart of FIG. 6 is premised on the configuration in which the user selects the mode in advance. However, this is not a limiting example. For example, the image forming apparatus 100 may be configured so that the user determines in which mode to discharge sheets S each time the user gives an instruction to print.

In the present exemplary embodiment, when sheets S are stored into the storage device 200, the controller 302 distributes the sheets S to different storage portions according to the job numbers of the sheets S. When sheets S are taken out of the storage device 200, the controller 302 exposes the sheets S belonging to the user who has instructed to discharge the sheets S from the opening 250 to the outside of the image forming apparatus 100. The user authentication is performed by the user inputting his/her own ID number into the external apparatus 300 or the operation display unit 307, or making the ID card read by an ID card reading unit (not illustrated) arranged on the operation display unit 307. In the present exemplary embodiment, as described above, the storage portions 201 to 203 individually include actuators for driving the respective sheet moving units 241 to 243. Therefore, if the sheets S belonging to the same user are stored in a plurality of storage portions, the respective actuators can be driven so that the user collectively receives the sheets S. The job numbers of the sheets S and user information indicating the instructions to print the sheets S are stored in the memory 305 included in the controller 302. According to the user's instruction to discharge sheets S, the controller 302 refers to the memory 305 to identify the sheets S to be discharged and instructs the storage device 200 to discharge the sheets S.

FIGS. 7A and 7B are diagrams illustrating operation examples of the storage device 200. In FIG. 7A, sheets S belonging to a user A are stored in the storage portion 201, and sheets S belonging to a user B are stored in the storage portions 202 and 203. Among the sheets S that the user B has instructed to print, sheets S having job number 1 are stored in the storage portion 202. Sheets S having job number 2 are stored in the storage portion 203. In FIG. 7B, if the sheets S belonging to the user B are instructed to be discharged, the sheet moving units 242 and 243 of the storage portions 202 and 203 move toward the opening unit 250 to expose a sheet bundle SB from the opening 250.

Figure 8:
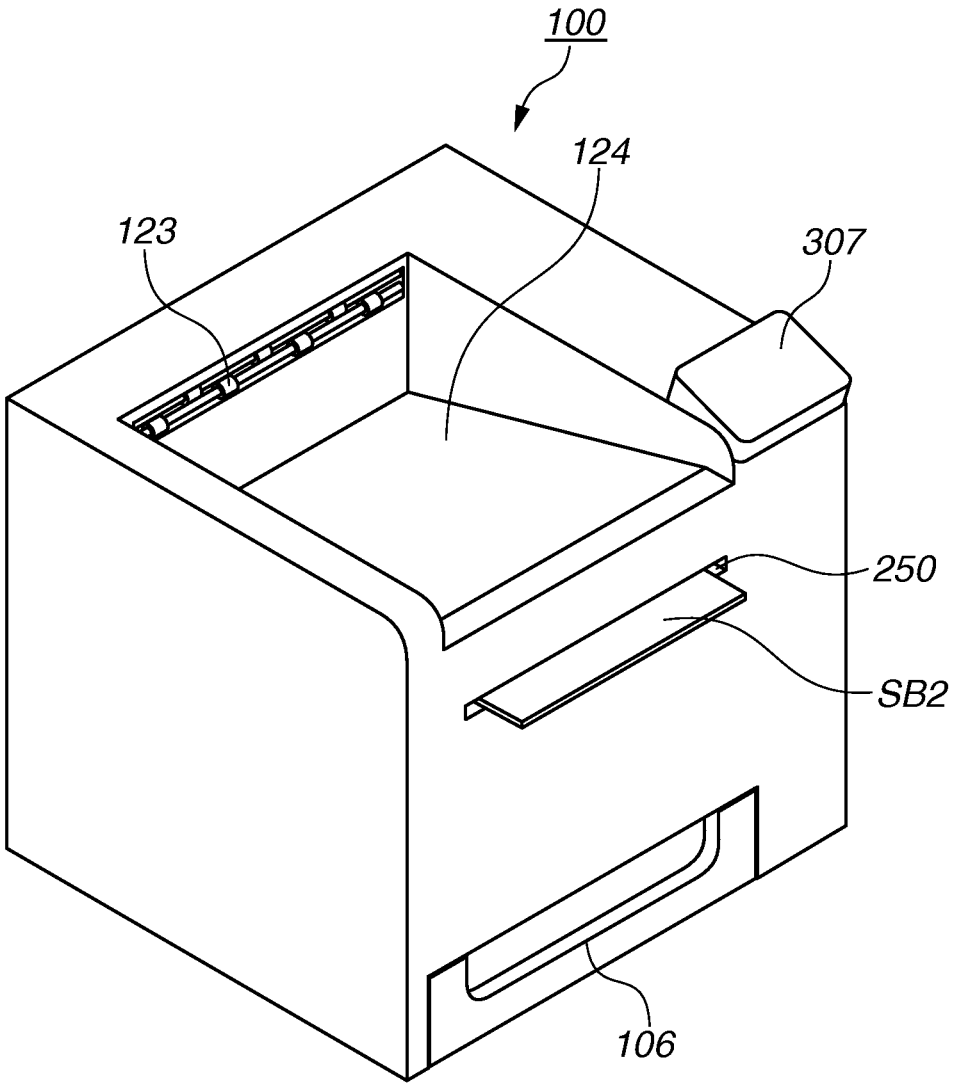
FIG. 8 is a perspective view of the image forming apparatus when exposing sheets according to the first exemplary embodiment.

FIG. 8 illustrates a perspective view of the image forming apparatus 100 at this moment. A leading edge SB2 of the sheet bundle SB exposed from the storage portions 202 and 203 are exposed out of the opening 250. The user can hold and pull the leading edge SB2 exposed to the outside of the image forming apparatus 100 to take out the sheet bundle SB.

If the user gives an instruction to store sheets S more than the number of sheets that can be stored in a single storage portion, the controller 302 distributes the sheets S, even with the same job number, into different storage portions. For example, in FIG. 7A, the sheets S belonging to the user B with different job numbers are stored in the respective storage portions 202 and 203. If the number of sheets of job number 1 is greater than the maximum number of sheets of the storage portion 202, the sheets S of job number 1 are distributed also to the storage portion 203. However, such distribution is premised on that no other sheet S is stored in the storage portion 203 at this moment. Here, "other sheets" include sheets having a different job number or belonging to a different user.

The storage device 200 is enclosed except a conveyance port (not illustrated) for conveying sheets S and the opening 250 for exposing the stored sheets S. The members enclosing the storage device 200 are made of opaque material. The information printed on the sheets S stored in the storage portions 201 to 203 is therefore not visible to users as long as the sheets S are stored in the storage portions 201 to 203. The user can thus prevent the information printed on his/her own sheets S from being seen by other users. This can improve confidentiality of information.

In terms of improving information confidentiality, there has conventionally been an image forming apparatus that performs user authentication using an ID card before starting image formation. Unlike such an apparatus, the image forming apparatus 100 according to the present exemplary embodiment only needs to perform the operation for exposing the sheets S on which an image is already formed from any of the storage portions 201 to 203. The user can thus take out the sheets S immediately after the user authentication, without waiting for the images to be formed.

With the foregoing configuration, the user can instruct the image forming apparatus 100 to discharge sheets S and take out only his/her own sheets S. This eliminates the need for the user to search for his/her own sheets S in the sheet-discharge tray 124 on which his/her and others' sheets S are stacked together.

(Description of User Authentication)

Next, the user authentication when sheets S are taken out from the storage device 200 will be described.

The sheet-discharge permission information 355 includes information about a sheet-discharge permission range and information about whether the sheet-discharge permission range is permitted to be changed. The sheet-discharge permission range refers to the range of users who have the authority to take out sheets S from the storage device 200. In the present exemplary embodiment, a narrower sheet-discharge permission range is set to "only the same user." A wider sheet-discharge permission range is set to "unlimited." If the sheet-discharge permission range is set to "only the same user," only the user who has instructed to print the sheets S can take out the sheets S from the storage device 200. If the sheet-discharge permission range is set to "unlimited," not only the user who has instructed to print the sheet S but anyone can take out the sheets S from the storage device 200. The information about whether the sheet-discharge permission range is permitted to be changed is intended to set whether to permit the controller 302 to automatically switch the sheet-discharge permission range according to conditions. In the present exemplary embodiment, the information is set to either "permitted" or "not permitted." If the information is set to "not permitted," changing the sheet-discharge permission range is prohibited. The information is usually set to "permitted." When printing a confidential document which should not be seen by anyone except the person himself/herself who has instructed to print, the information is set to "not permitted." The storage device 200 is enclosed except the conveyance port (not illustrated) for conveying sheets S and the opening 250 for exposing the stored sheets S. The members enclosing the storage device 200 are made of opaque material. The information printed on the sheets S stored in the storage portions 201 to 203 is therefore not visible to users as long as the sheets S are stored in the storage portions 201 to 203.

In the present exemplary embodiment, the user information 356 is information that is assigned to each user and from which the user can be identified. The user information 356 includes two information items, i.e., the user's ID number and the presence or absence of printer management authority. The information about the presence or absence of the printer management authority is set to either "authorized" or "not authorized." If the user has the printer management authority, the user needs to perform maintenance of the printer. Therefore, such a user can take out all sheets S from the storage device 200 regardless of the sheet-discharge permission range. In the present exemplary embodiment, the user authentication refers to the CPU 302's determination whether to permit to discharge sheets S from the storage device 200 based on the sheet-discharge permission information 355 and the user information 356. In other words, the user authentication refers to determining whether the user identified by the user information 356 is included in the sheet-discharge permission range, i.e., the sheet-discharge permission information 355. If the user is included in the sheet-discharge permission range, the user authentication has succeeded and the controller 302 permits the user to take out the sheets S from the storage device 200. On the other hand, if the user is not included in the sheet-discharge permission range, the user authentication has failed and the controller 302 prohibits the user from taking out the sheets S from the storage device 200.

FIGS. 9A and 9B illustrate specific examples of the user authentication. The following description is premised on the state that sheets S are already stored in all the storage portions 201 to 203.

FIG. 9A illustrates the job numbers of the sheets S stored in the storage portions 201 to 203, the users who have instructed to print the sheets S, and the sheet-discharge permission information 355. FIG. 9B illustrates the user information 356 for identifying the users. The user A has the printer management authority and can take out the sheets S stored in the storage portions 201 to 203. The user B does not have the printer management authority and can take out the sheets S stored in the storage portion 202 which the user B has instructed to print. Since the sheet-discharge permission range of the sheets S stored in the storage portion 203 is set to "unlimited," the user B can also take out these sheets S. The user C does not have the printer management authority and can take out the sheets S stored in the storage portion 203. If there is a plurality of storage portions from which sheets S can be taken out by a user such as the users A and B, the operation display unit 307 may display a selection screen for selecting which sheets S to be taken out.

(Description of Change of Sheet-Discharge Permission Range)

Figure 10:
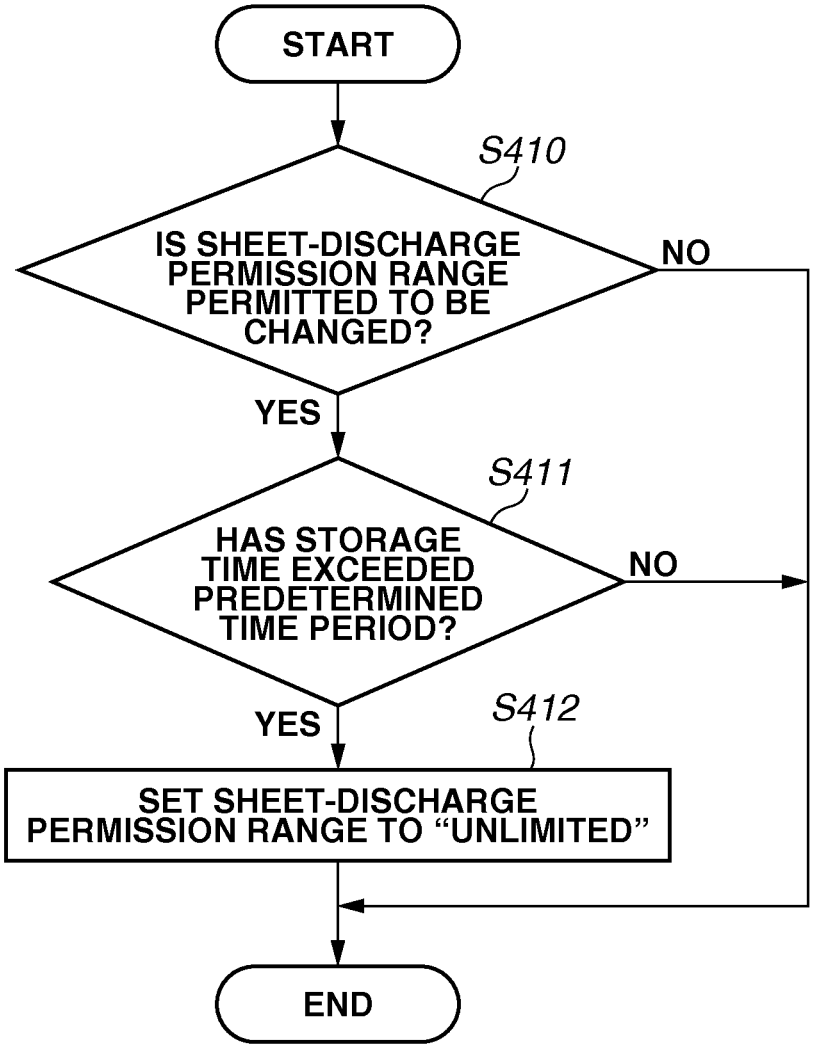
FIG. 10 is a flowchart concerning a change of the sheet-discharge permission range according to the first exemplary embodiment.

The user can perform the user authentication to take out only his/her own sheets S. If the user forgets to take out his/her sheets S, the next user may not be able to use the storage device 200 since users who can take out the sheets are limited. In the present exemplary embodiment, the sheet-discharge permission range is therefore widened according to the time period during which the sheets S have been stored in the storage portions 201 to 203. Widening the sheet-discharge permission range enables users other than the user who has instructed to print sheets S to take out the sheets S. This can reduce the time until the storage device 200 becomes available to the next user. FIG. 10 illustrates a flowchart when the sheet-discharge permission range is changed according to the present exemplary embodiment. The control in the flowchart is performed by the controller 302 described in FIG. 4 based on a program stored in the memory 305.

In step S410, the controller 302 checks whether the sheet-discharge permission range is permitted to be changed from the sheet-discharge permission information 355 corresponding to the sheets S stored in the storage device 200. If the sheet-discharge permission range is not permitted to be changed (NO in step S410), the processing ends. If the sheet-discharge permission range is permitted to be changed (YES in step S410), then in step S411, the controller 302 determines whether the time period during which the sheets S have been stored in the storage portion exceeds a predetermined time period. The time period during which the sheets S have been stored in the storage portion (storage time period) is counted from the timing at which the sheet presence/absence sensor detects the first sheet S. In the present exemplary embodiment, the predetermined time period is one hour. If the controller 302 determines that the storage time period has not exceeded the predetermined time period (NO in step S411), the processing ends. If the controller 302 determines that the storage time period has exceeded the predetermined time period (YES in step S411), then in step S412, the controller 302 sets the sheet-discharge permission range to "unlimited."

Here, the controller 302 may notify the user via the external apparatus 300 or the operation display unit 307 that the sheet-discharge permission range of the sheets S is changed to "unlimited." The controller 302 may directly send an email about the change to the user. The controller 302 may print information about the change on a sheet S and discharge the sheet S to the sheet-discharge tray 124.

For example, in the case of FIGS. 9A and 9B, a new user D who wants to use the storage device 200 can take out only the sheets S stored in the storage portion 203 and not those stored in the storage portions 201 and 202. After the storage time period of the sheets S has exceeded the predetermined time period of one hour, the sheet-discharge permission range of the sheets S having job number 2, stored in the storage portion 202, is changed to "unlimited." The user D can thus take out the sheets S stored in both the storage portions 202 and 203. On the other hand, the sheet-discharge permission range of the sheets S stored in the storage portion 201 is not permitted to be changed. The sheet-discharge permission range of the sheets S stored in the storage portion 201 is thus not changed even if the storage time period of the sheets S has exceeded the predetermined time period.

As described above, according to the present exemplary embodiment, the sheet-discharge permission range of the sheets S can be widened according to the time period during which the sheets S have been stored in the storage portions 201 to 203. This can reduce the time until the storage portions 201 to 203 become available to other users.

In a second exemplary embodiment, the sheet-discharge permission range of sheets is changed according to a relationship between the number of pages of the next job and the number of pages that can be stored in an available storage portion, in addition to the time period during which the sheets have been stored in the storage portions. A description of main parts is similar to that of the first exemplary embodiment. Only differences from the first exemplary embodiment will be described below.

Figure 11:
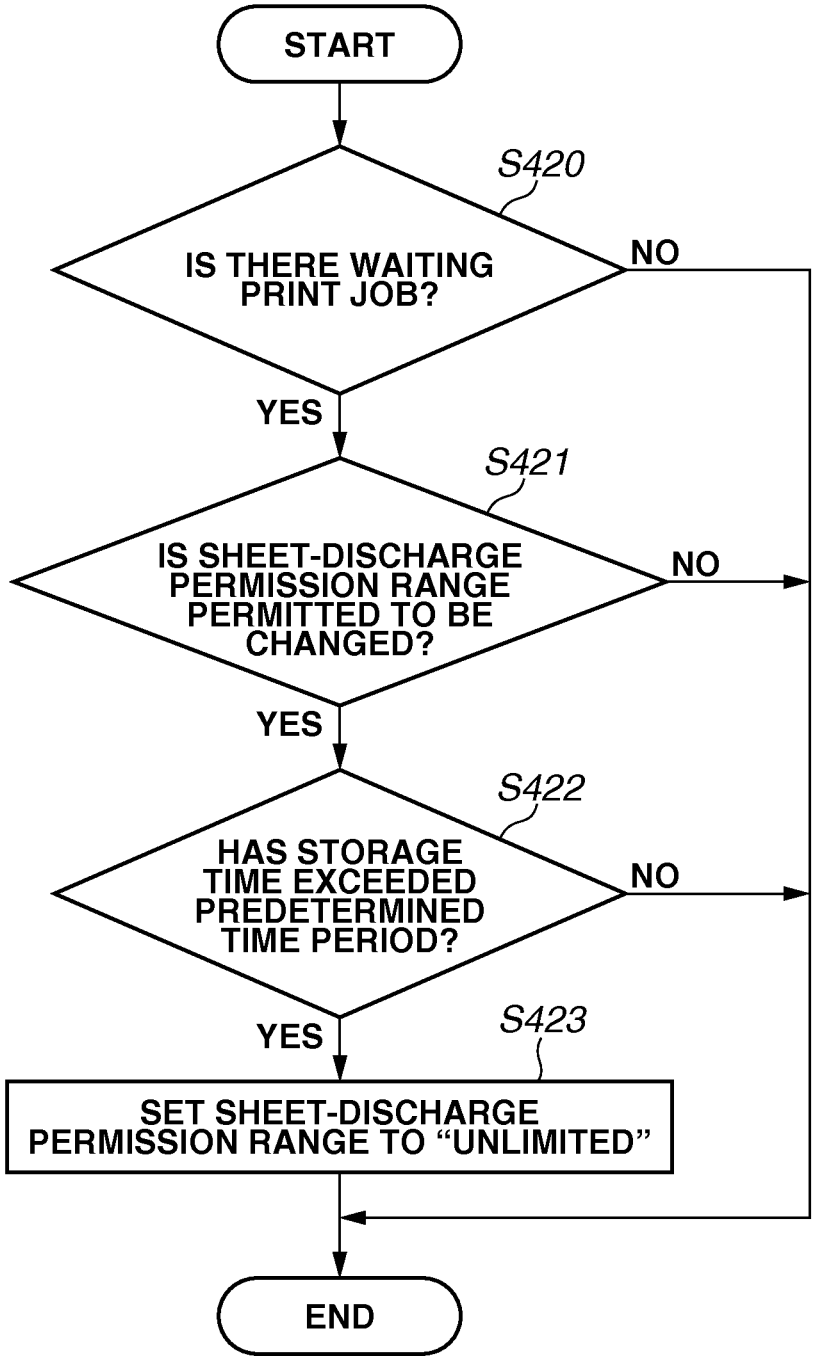
FIG. 11 is a flowchart concerning a change of the sheet-discharge permission range according to a second exemplary embodiment.

In the first exemplary embodiment, if the storage time period of the sheets S has exceeded the predetermined time period, the sheet-discharge permission range is widened without any exception. However, if there is no user who wants to use the storage device 200 next, i.e., if there is no waiting print job, the sheet-discharge permission range need not necessarily be widened. FIG. 11 illustrates a flowchart when the sheet-discharge permission range is changed according to the present exemplary embodiment. The control in the flowchart is performed by the controller 302 described in FIG. 4 based on a program stored in the memory 305.

In step S420, the controller 302 checks whether there is a waiting print job. Here, the waiting print job refers to a job that is instructed to be printed by a user and remains on standby because the storage device 200 is not able to store the sheets S. In other words, the waiting print job refers to a job for printing sheets S more than the number of sheets that can be stored in the storage device 200. For example, FIG. 12A illustrates a case where sheets S are stored in all the storage portions 201 to 203. In such a case, the number of sheets that can stored in the storage device 200 is zero. Assume that the number of sheets that can be stored in each of the storage portions 201 to 203 is ten. If the storage portion 203 is available as illustrated in FIG. 12B, the number of sheets that can be stored in the storage device 200 is ten. Step S421 and the subsequent steps are similar to the steps of the first exemplary embodiment, and thus a description thereof will be omitted.

If there is no waiting print job in the case of FIG. 12A, for example, the sheet-discharge permission range is not changed even when the storage time period of the sheets S stored in the storage portion 203 has exceeded the predetermined time period of one hour. Therefore, another user J cannot take out the sheets S. If the user J gives an instruction to print and there is a waiting print job, the sheet-discharge permission range is changed because the storage time period of the sheets stored S in the storage portion 203 has exceeded the predetermined time period. As a result, the user J who wants to use the storage device 200 next can take out the sheets S from the storage portion 203. Similarly, if there is no waiting print job in the case of FIG. 12B, the sheet-discharge permission range is not changed even when the storage time period of the sheets S stored in the storage portion 202 has exceeded the predetermined time period. Therefore, another user J cannot take out the sheets S. If the user J gives an instruction to print ten sheets or less which can be stored in the storage device 200, the sheets S belonging to the user J are stored into the storage portion 203. If the user J gives an instruction to print more than ten sheets, the job becomes a waiting print job because the storage device 200 cannot store the sheets S. When there is a waiting print job, the sheet-discharge permission range is changed because the storage time period of the sheets S stored in the storage portion 202 has exceeded the predetermined time period. As a result, the user J who wants to use the storage device 200 next can take out the sheets S from the storage portion 202.

As described above, according to the present exemplary embodiment, the sheet-discharge permission range is widened according to the relationship between the number of pages of the next job and the number of pages that can be stored in an available storage portion, in addition to the time period during which the sheets S have been stored in the storage portions 201 to 203. This can reduce the time until the storage portions 201 to 203 become available to other users. As compared to the first exemplary embodiment, the sheet-discharge permission range can be kept narrow for a longer time.

In the present exemplary embodiment, if there is a waiting print job, the sheet-discharge permission range can be widened and changed to "unlimited." However, the sheet-discharge permission range may be widened only to the user corresponding to the waiting print job.

Figure 13:
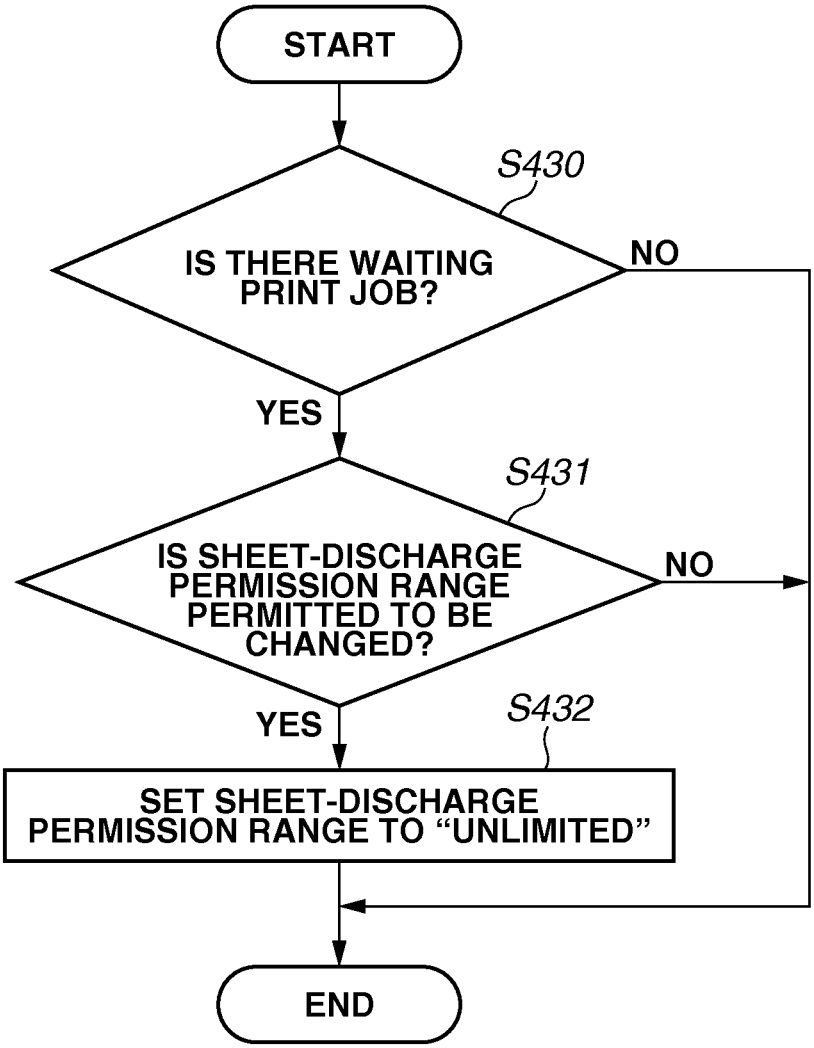
FIG. 13 is a flowchart concerning a change of the sheet-discharge permission range according to a third exemplary embodiment.

In the first and second exemplary embodiments, the sheet-discharge permission range is changed according to the time period during which the sheets S have been stored in the storage portions 201 to 203. In a third present exemplary embodiment, the sheet-discharge permission range is changed according to the relationship between the number of pages of the next job and the number of pages that can be stored in an available storage portion. A description of main parts is similar to that of the first exemplary embodiment. Only differences from the first exemplary embodiment will be described below. FIG. 13 illustrates a flowchart when the sheet-discharge permission range is changed according to the present exemplary embodiment. The control in the flowchart is performed by the controller 302 described in FIG. 4 based on a program stored in the memory 305.

In step S430, the controller 302 checks whether there is a waiting print job. Here, the waiting print job refers to a job that is instructed to be printed by a user and remains on standby because the storage device 200 cannot store the sheets S. In other words, the waiting print job refers to a job for printing sheets S more than the number of sheets that can be stored in the storage device 200. If there is no waiting print job (NO in step S430), the processing ends. If there is a waiting print job (YES in step S430), then in step S431, the controller 302 checks whether the sheet-discharge permission range is permitted to be changed from the sheet-discharge permission information 355 corresponding to the sheets S stored in the storage device 200. If the sheet-discharge permission range is not permitted to be changed (NO in step S431), the processing ends. If the sheet-discharge permission range is permitted to be changed (YES in step S431), then in step S432, the controller 302 sets the sheet-discharge permission range to "unlimited." Here, the controller 302 may notify the user via the external apparatus 300 or the operation display unit 307 that the sheet-discharge permission range is changed to "unlimited." The controller 302 may directly send an email about the change to the user. The controller 302 may print information about the change on a sheet S and discharge the sheet S to the sheet-discharge tray 124.

As described above, according to the present exemplary embodiment, the sheet-discharge permission range is widened according to the relationship between the number of pages of the next job and the number of pages that can be stored in an available portion. This can reduce the time until the storage portions 201 to 203 become available to other users.

In the foregoing exemplary embodiments, the sheet moving units 241 to 243 of the storage portions 201 to 203 include the respective actuators. The actuators can be simultaneously driven to expose sheets S stored in a plurality of storage portions in a stacked manner. However, actuators fewer than the number of storage portions 201 to 203 may be provided. For example, a drive transmission switch unit such as a clutch (not illustrated) may be provided to selectively move a plurality of sheet moving units by a single actuator.

In the foregoing exemplary embodiments, the controller 302 includes the memory 305. However, the memory 305 may be included in the engine control unit 303 or the storage device control unit 304. An independent memory 305 may be included in the image forming apparatus control unit 301.

In the foregoing exemplary embodiments, the engine control unit 303 and the storage device control unit 304 are separately configured. However, only the engine control unit 303 may be provided. In such a case, the engine control unit 303 controls the conveyance unit 105 and the storage device 200.

In the foregoing exemplary embodiments, the conveyance paths of the sheets S have been described to be configured to join together at the downstream side of the storage portions 201 to 203 to have a single opening 250. However, a plurality of openings may be separately provided. The sheets S stored in the storage portions 201 to 203 may be exposed from respective different openings.

In the foregoing exemplary embodiments, the image forming apparatus 100 has been described to include the three storage portions 201 to 203. However, the number of storage portions is not limited to three. The number of storage portions may be set according to an environment in which the main body of the image forming apparatus 100 is used, the number of users who share the image forming apparatus 100, and/or specifications of the main body of the image forming apparatus 100.

The foregoing exemplary embodiments have been described using with the case where the storage device 200 is integrally configured with the image forming apparatus 100. However, the storage device 200 may be provided to be detachably attachable to the image forming apparatus 100. In such a case, a control unit included in the image forming apparatus 100 may control the operation of the storage device 200. The storage device 200 may include an independent control unit, which may communicate with a control unit included in the image forming apparatus 100 and control the operation. The operation display unit 307 may be included in the storage device 200.

In the foregoing exemplary embodiments, the users manually set the sheet-discharge permission range from the external apparatus 300 or the operation display unit 307. However, the controller 302 may automatically set the sheet-discharge permission range. For example, if the controller 302 determines from an ID number serving as the user information 356 that the user who instructs to print is a managerial staff, the controller 302 sets "only the same user" and "not permitted" as the sheet-discharge permission information 355. If the controller 302 determines that the user who instructs to print is a non-managerial staff, the controller 302 sets "only the same user" and "permitted" as the sheet-discharge permission information 355. In such a case, a table associating the ID numbers of users with their titles (managerial or non-managerial staff) is stored in the memory 305 in advance.

In the foregoing exemplary embodiments, the sheet-discharge permission range is associated with the job numbers. However, the sheet-discharge permission range may be associated with the storage portions 201 to 203. For example, the controller 302 sets sheet-discharge permission information 355 indicating a sheet-discharge permission range of "only the user A" for the storage portion 201 in advance. The user A then gives an instruction to print, and sheets S on which an image is formed are conveyed to the storage portion 201. The sheets S stored in the storage portion 201 can be taken out only by the user A. In such a manner, the sheet-discharge permission range can be associated with the storage portions 201 to 203.

In the foregoing exemplary embodiments, the predetermined time period serving as a reference for changing the sheet-discharge permission range of the sheets S is fixed to one hour. However, the predetermined time period may be set appropriately by the users from the external apparatus 300 or the operation display unit 307. The time period during which sheets S have been stored in a storage portion may be counted from the timing at which the image forming unit 101 starts an image forming operation on the first sheet.

In the foregoing exemplary embodiments, the sheet-discharge permission range has been described to include only two possible levels "only the same user" and "unlimited." However, "only the same group" and the like may be added to provide the sheet-discharge permission range in three or more levels. In such a case, the sheet-discharge permission range can be switched stepwise according to the length of the storage time period and the number of waiting print jobs.

The foregoing exemplary embodiments have been described using examples of a laser beam printer. However, any other type of printer of other printing methods such as an inkjet printer and copying machines are applicable.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2014-084713 filed Apr. 16, 2014, which is hereby incorporated by reference herein in its entirety.

What is claimed is:

1. An image forming apparatus comprising:

an apparatus main body formed with an opening;

an image forming unit configured to form an image on a sheet;

a plurality of storage portions each configured to store the sheet on which the image is formed inside the apparatus main body;

a moving unit configured to move the sheet stored in a storage portion included in the plurality of storage portions and expose the sheet outside of the apparatus main body via the opening; and a control unit configured to permit the moving unit to move and expose a first sheet stored in the storage portion if the control unit receives information about a first user who has instructed to print the first sheet, wherein the control unit is configured to, in a case where the control unit is not instructed to print more sheets than the number of sheets that can be stored in the plurality of storage portions, prohibit the moving unit from moving and exposing the first sheet if the control unit receives information about a second user different from the first user, and in a case where the control unit is instructed to print more sheets than the number of sheets that can be stored in the plurality of storage portions, permit the moving unit to move and expose the first sheet if the control unit receives the information about the second user.

2. The image forming apparatus according to claim 1, wherein the control unit is configured to, in a case where the control unit is instructed to print more sheets than the number of sheets that can be stored in the plurality of storage portions and a time period during which the first sheet has been stored in the storage portion has not exceeded a predetermined time period, prohibit the moving unit from moving and exposing the first sheet if the control unit receives the information about the second user, and in a case where the control unit is instructed to print more sheets than a number of sheets that can be stored in the plurality of storage portions and the time period during which the first sheet has been stored in the storage portion has exceeded the predetermined time period, permit the moving unit to move and expose the first sheet if the control unit receives the information about the second user.

3. The image forming apparatus according to claim 2, further comprising a detection unit configured to detect that the sheet has been stored in the storage portion, wherein the time period during which the first sheet has been stored in the storage portion is counted from a time at which the detection unit detects the first sheet.

4. The image forming apparatus according to claim 2, wherein the time period during which the first sheet has been stored in the storage portion is counted from a time at which the image forming unit starts an image forming operation on the first sheet.

5. The image forming apparatus according to claim 2, further comprising a changing unit configured to be able to change the predetermined time period.

6. The image forming apparatus according to claim 1 wherein, in a case where each of the plurality of storage portions stores a sheet, the number of sheets that can be stored in the plurality of storage portions is zero.

7. The image forming apparatus according to claim 1, wherein, in a case where at least one storage portion among the plurality of storage portions does not store a sheet, the number of sheets that can be stored in the plurality of storage portions is the number of sheets that can be stored in the at least one storage portion in which a sheet is not stored.

8. The image forming apparatus according to claim 1, wherein the control unit is configured to, in a case where the control unit is instructed to print more sheets than the number of sheets that can be stored in the plurality of storage portions and the control unit receives information for prohibiting the moving unit from moving and exposing the first sheet based on information about a user other than the first user, prohibit the moving unit from moving and exposing the first sheet if the control unit receives the information about the second user.

9. The image forming apparatus according to claim 1, further comprising a notification unit configured to provide notification to the first user, the notification being that the control unit is switched to a state where the control unit permits the moving unit to move and expose the first sheet if the control unit receives the information about the second user.

10. The image forming apparatus according to claim 1, wherein the moving unit moves the sheet stored in the storage portion and stops the sheet in an exposure state where a part of the sheet is exposed from the opening to an outside of the apparatus main body.

* * * * *